US011589694B2

(12) United States Patent
Shokrian

(10) Patent No.: US 11,589,694 B2
(45) Date of Patent: Feb. 28, 2023

(54) PILLOW COVER WITH INTEGRATED SUPPORT

(71) Applicant: Janice Shokrian, Lake Oswego, OR (US)

(72) Inventor: Janice Shokrian, Lake Oswego, OR (US)

(73) Assignee: TAUSI BRANDS, Lake Oswego, OR (US)

( * ) Notice: Subject to any disclaimer, the term of this patent is extended or adjusted under 35 U.S.C. 154(b) by 216 days.

(21) Appl. No.: 16/512,593

(22) Filed: Jul. 16, 2019

(65) Prior Publication Data

US 2020/0022510 A1 Jan. 23, 2020

Related U.S. Application Data

(60) Provisional application No. 62/701,110, filed on Jul. 20, 2018.

(51) Int. Cl.

| | |
|---|---|
| ***A47G 9/02*** | (2006.01) |
| ***A47C 7/38*** | (2006.01) |
| ***A47G 9/00*** | (2006.01) |
| ***A47G 9/10*** | (2006.01) |

(52) U.S. Cl.

CPC ..... *A47G 9/0253* (2013.01); *A47C 7/383* (2013.01); *A47G 9/007* (2013.01); *A47G 9/10* (2013.01); *A47G 2009/001* (2013.01)

(58) Field of Classification Search

CPC ..... A47G 9/0253; A47G 9/007; A47G 9/10; A47G 2009/001; A47C 7/383

USPC ..... 5/636

See application file for complete search history.

(56) References Cited

U.S. PATENT DOCUMENTS

| | | | | | |
|---|---|---|---|---|---|
| 382,949 | A | * | 5/1888 | Campbell | A47C 7/383 297/393 |
| 1,349,072 | A | * | 8/1920 | Lines | A47G 9/10 5/636 |
| 1,386,652 | A | * | 8/1921 | Patton | A47G 9/10 5/640 |
| 2,464,435 | A | * | 3/1949 | Conradt | B60N 2/882 297/397 |
| 2,817,391 | A | * | 12/1957 | Zacks | B60N 2/6054 297/229 |
| 3,638,251 | A | * | 2/1972 | Weiss | A47G 9/02 5/490 |
| D237,569 | S | * | 11/1975 | DeRue | D6/599 |
| 3,926,181 | A | * | 12/1975 | Eischen, Sr. | A61G 13/12 602/18 |
| 4,042,278 | A | * | 8/1977 | Jensen | A47C 7/383 297/397 |
| 4,607,402 | A | * | 8/1986 | Pollard | A47D 15/008 D6/333 |
| 4,754,513 | A | | 7/1988 | Rinz | |
| 4,908,893 | A | | 3/1990 | Smit | |
| 5,054,854 | A | * | 10/1991 | Pruit | A47C 7/467 297/284.3 |

(Continued)

*Primary Examiner* — Myles A Throop

(74) *Attorney, Agent, or Firm* — Miller Nash LLP

(57) ABSTRACT

A pillow cover has a pillow case having a pocket, a pocket opening, a cavity, and an opening, the opening configured to allow the pillow case to receive a standard-sized pillow into the cavity, a support pillow insert insertable into the pocket through the pocket opening to form a support pillow on the surface the pillow case, and an attachment to allow the pillow cover to be adjustably attached to a chair.

7 Claims, 11 Drawing Sheets

(56) References Cited

U.S. PATENT DOCUMENTS 5,084,928 A 2/1992 Skillington
5,157,799 A 10/1992 Aird
5,168,590 A * 12/1992 O'Sullivan ..... A47G 9/0253 5/421
5,481,771 A * 1/1996 Burk, IV ..... A47G 9/10 5/490
5,647,076 A * 7/1997 Gearhart ..... A47C 20/025 5/631
5,809,594 A * 9/1998 Isogai ..... A47G 9/10 5/644
6,017,094 A * 1/2000 Syiek ..... B60N 2/882 297/DIG. 6
6,671,906 B1 * 1/2004 Milligan ..... A47G 9/109 5/636
7,089,617 B1 8/2006 Lauro
7,120,952 B1 * 10/2006 Bass ..... A47C 27/006 5/484
7,165,279 B1 * 1/2007 Georgescu ..... A47G 9/10 5/490
7,428,763 B2 9/2008 Hightower
7,730,564 B2 6/2010 Moore
8,726,435 B2 5/2014 Briody
8,990,980 B1 3/2015 Hindley
9,629,468 B1 * 4/2017 McCabe ..... A47C 7/383
9,635,962 B2 5/2017 Sternlight et al.
9,924,812 B1 * 3/2018 Kennedy ..... A47G 9/02
10,464,458 B2 * 11/2019 Blankenship ..... B64D 11/062
10,583,030 B2 * 3/2020 Mattson ..... A61F 5/56
2004/0107502 A1 * 6/2004 Boone ..... A47G 9/0253 5/636
2005/0150051 A1 * 7/2005 Greenawalt ..... A47G 9/10 5/636
2008/0028520 A1 2/2008 Rosier
2008/0034503 A1 2/2008 Hightower
2010/0024130 A1 2/2010 Moore
2010/0077551 A1 4/2010 Liu et al.
2013/0025052 A1 1/2013 Briody
2013/0312192 A1 * 11/2013 Lee ..... A47C 7/425 5/639
2014/0026323 A1 * 1/2014 Bowers ..... A47G 9/10 5/636
2014/0317851 A1 * 10/2014 Hammack ..... A47G 9/10 5/636
2015/0230635 A1 8/2015 Abrams
2015/0351564 A1 * 12/2015 Vogel ..... A47G 9/1054 5/640
2016/0242580 A1 * 8/2016 Batiste ..... A47G 9/0253
2016/0309928 A1 10/2016 Lukin, Jr.
2016/0346113 A1 * 12/2016 Mattson ..... A61F 5/56
2017/0050547 A1 * 2/2017 Dunham ..... A47C 7/383
2017/0303688 A1 * 10/2017 McCabe ..... A47C 7/383
2019/0045950 A1 * 2/2019 Smith ..... A47G 9/10
2020/0288877 A1 * 9/2020 Duong ..... A47G 9/10

* cited by examiner

PILLOW COVER WITH INTEGRATED SUPPORT

CROSS REFERENCE TO RELATED APPLICATION

This application claims priority to and the benefit of U.S. Provisional Application No. 62/701,110 filed Jul. 20, 2018, which is incorporated herein by reference in its entirety.

TECHNICAL FIELD

This disclosure relates to pillow covers, more particularly to a neck and head support integrated into the cover.

BACKGROUND

Pillows are a ubiquitous form of comfort. Pillows are sold in various styles, sizes, contouring and are used for travel. People are always on the hunt for a pillow that will ensure reliable comfort. There exists thousands of styles to choose from when seeking the right level of density and personal support.

Traditional pillow covers usually comprise of a front and back with either a side opening or an envelope opening in the middle of the back panel to allow the user to insert the pillow of their choice. There exists a pillow cover on the market that only has a neck support. This pillow cover adequately responds to the user's need for neck support. However, the pillow cover is to be used while sleeping in a bed in a horizontal position.

The drawback of this pillow cover is that it cannot support the head of a sleeping person when they fall asleep while sitting upright. Oftentimes, the infirmed or elderly fall asleep while sitting in geriatric chairs and their heads fall forward or to the side causing unnecessary neck strain. There is another pillow that reaches over the top of the chair but it only supports the neck of the person.

In summary, the design of existing pillow and pillow covers cannot satisfy the current needs of people who would like the comfort of knowing that their head will be supported while they rest in an upright position. The user will rest assured knowing that their favorite pillow is securely encased in the pillow cover that is also secured to the back of the chair. This assurance will give the user many hours of rest and comfort.

DETAILED DESCRIPTION OF THE EMBODIMENTS

Figure 1:
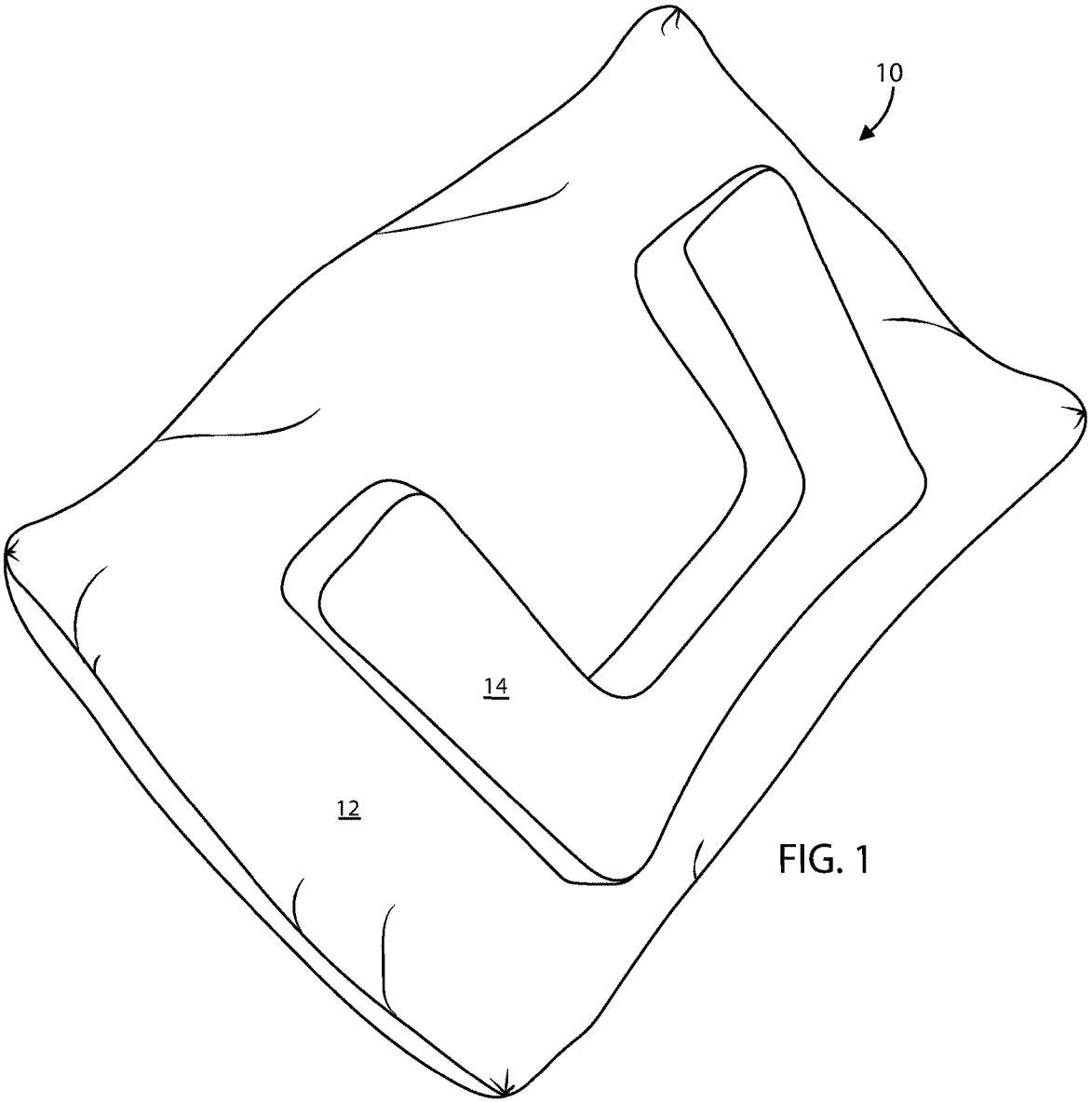
FIG. 1 shows an embodiment of a pillow cover having a pillow case with a support pillow and the pillow case contains a bed pillow.

The embodiments relate to a supportive pillow cover that attaches to a geriatric chair, medical bed, high back chair that furnishes support to embrace sleeping user's head and neck and prevents head roll. This allows maintenance of a supine sleeping position. This helps those suffering from medical issues that require them to keep a stable neck and limit the range of motion of the user's head.

People who are in hospitals, born with an infirmity, or live in a senior community have many levels of care. For many they spend their day in a geriatric chair or a supportive apparatus. These people have a bed pillow to supports their head as they watch television, participate in activities, eat their meals, and are used for comfort while they nap in the chair. Oftentimes these pillows will slide down the back of the chair or fall off the chair.

The embodiments here provide a pillow cover that can slip onto a user's pillow and the pillow cover can be attached to the back of a chair using its secure top and side straps. The straps prevent the pillow from slipping off or down the chair. This ensures that the caregiver is caring for the patient and not spending time on picking up pillows. The straps also allow the pillow cover and pillow to adjust the position of the support pillow to ensure that the user fits his or her head in the most comfortable position for resting and/or sleeping.

As used here, the term 'pillow' by itself refers to the user's pillow of a standard size, such as 'standard,' 'queen,' 'king,' and 'travel.' The term 'pillow case' means the portion of a 'pillow cover' that slides over a pillow. The pillow case includes a 'support pillow' that refers to the portion of the pillow case that protrudes from the surface of the pillow case to provide head and/or neck support. The support pillow is formed by a 'support pillow insert' that inserts into a pocket, mount, or recess, all of which will be referred to here as a pocket. The term 'secondary pillow' refers to an external pillow that is sized to fit inside the protrusion of the support pillow.

In the below embodiments, two different openings may exist. A first 'pillow opening' comprises the opening in the pillow case that allows the user to insert a standard sized pillow into the case. This opening may be on the ends of the pillow case, or an 'envelope' opening in the center of the case. The second opening comprises a 'pocket opening' that allows insertion of the support pillow insert into the portion of the pillow case that forms the support pillow. This may be located on the front of the pillow case and may have a closure such as a zipper, hook and loop, buttons, etc. As discussed above, the pillow may be mounted to the pillow case on a top mount.

The term 'pillow cover' refers to the combination of the pillow case, the support pillow, the support pillow insert, and the pocket or other mount for the secondary pillow. The user is able to use his or her own pillow to incorporate with the pillow cover. This allows the user to use his or her own pillow, and while the support of the pillow cover provides additional and substantial support for the user's head and/or neck, or as a lumbar support, etc., the user can remove the pillow cover and use his or her own pillow. However, the pillow cover can assist in keeping the neck of the user in alignment with the spine while sleeping.

The pillow cover is extremely portable such that the user is able to always carry the pillow cover with him or her especially in the travel time. The user can carry the pillow cover only and incorporate it with any existing pillow provided by others. This may include hospitals, hotels, airplanes, or senior communities, as examples. In addition, the pillow cover without the standard pillow can be used on furniture, such as recliners and other types of chairs that already have built-in support.

Figure 2:
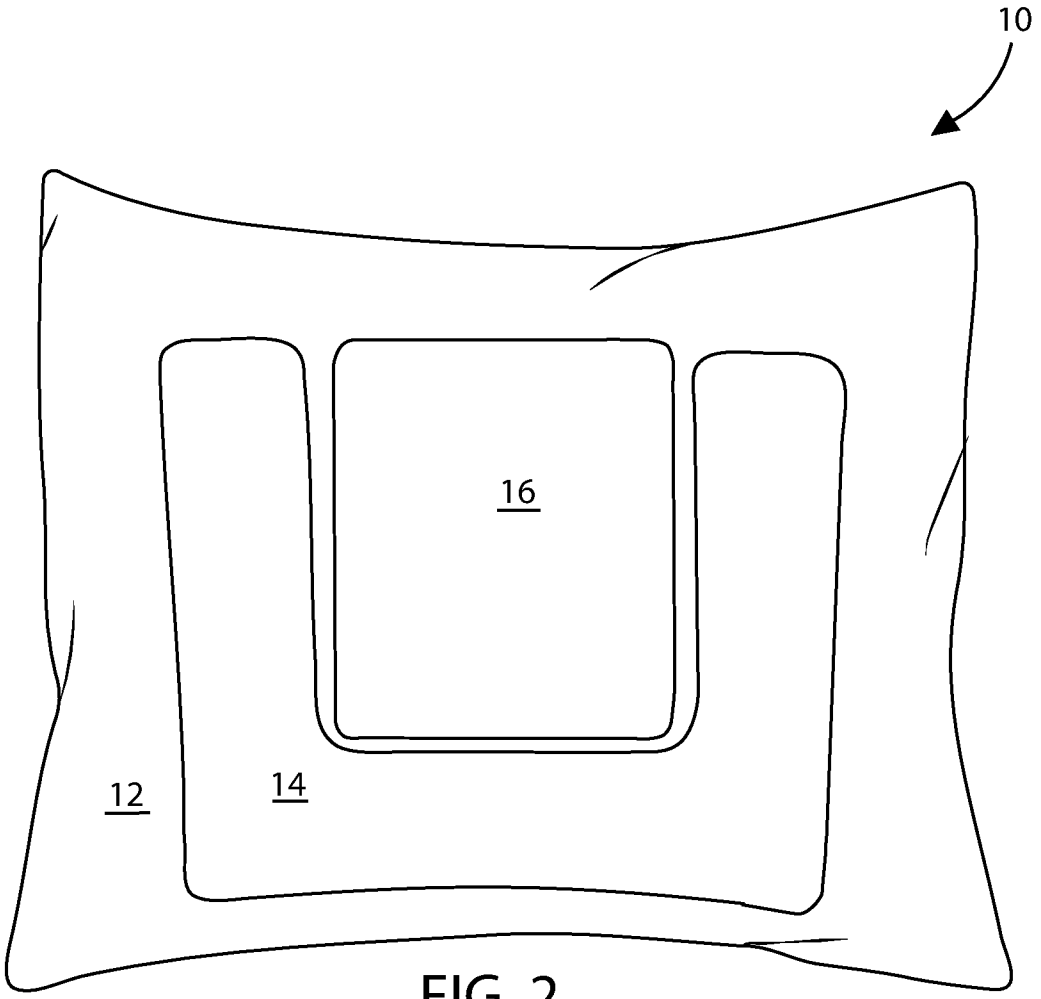
FIG. 2 shows a top view of an embodiment of a pillow cover comprising a pillow case with a support pillow and a secondary pillow

FIG. 1 shows an embodiment of a pillow cover 10. As stated above, the pillow cover comprises a pillow case 12 having a protruding portion 14. The protruding portion 14 comprises the support pillow. FIG. 2 shows a pillow cover 10, with the pillow case 12 and the support pillow 14. In addition, FIG. 2 shows the secondary pillow 16. The secondary pillow 16 will generally fit inside the boundaries defined on the top and sides of the support pillow. The protruding portion may actually comprise a second pillow mounted to the top of the pillow case.

Figure 3:
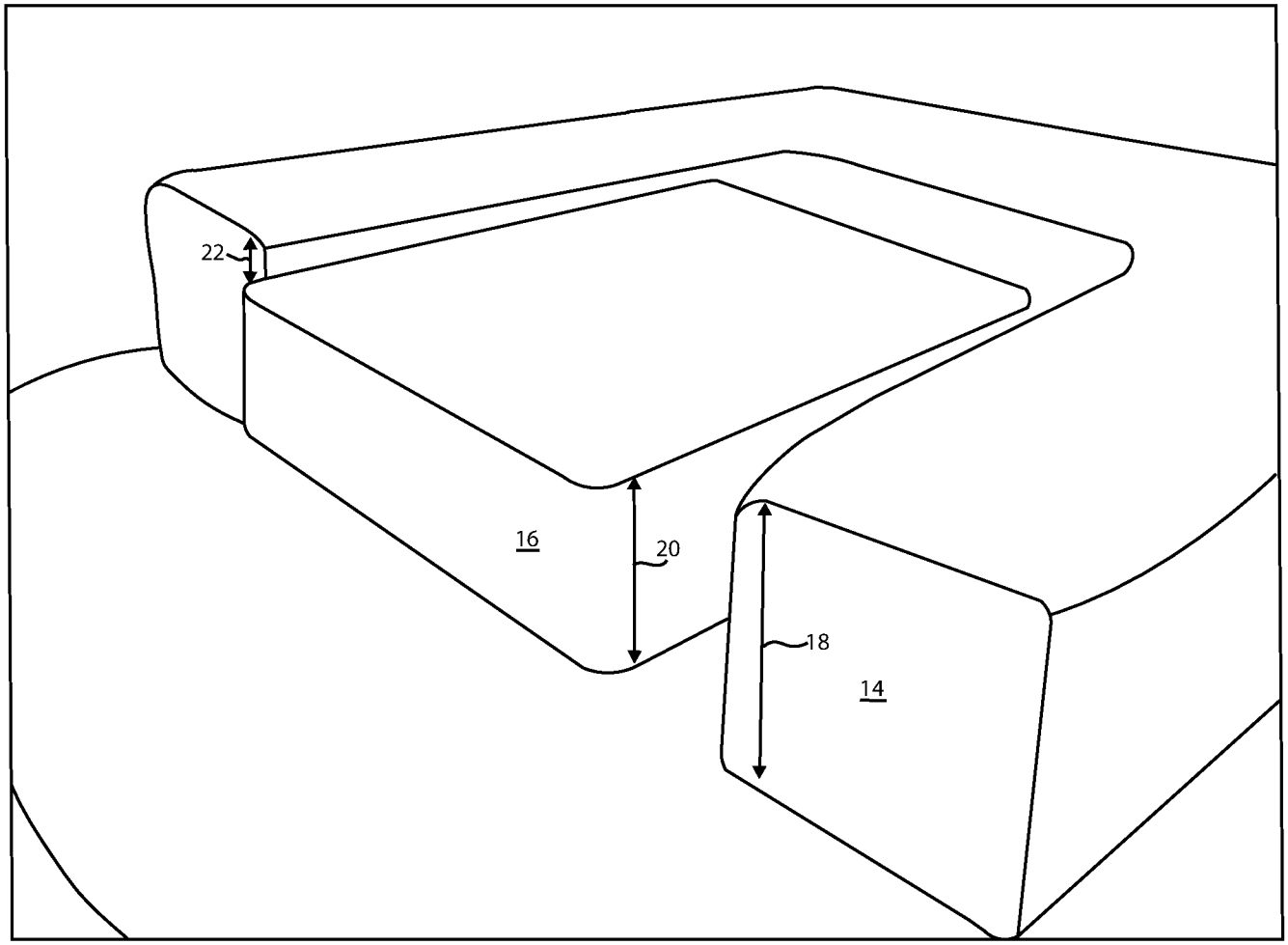
FIG. 3 shows a side view of a pillow cover comprising a pillow case with an inserted support pillow and a secondary pillow.

In addition, as shown in a side view of FIG. 3, one embodiment of the secondary pillow does not extend past the depth of the support pillow. The support pillow has a depth shown by arrow 18, and the secondary pillow has a depth shown by the arrow 20. The difference between the two is shown by arrow 22. This is just one embodiment, but for the user to rely upon the side to side support and holding of the user's head in place, if the secondary pillow extends beyond the protrusion of the support pillow.

Figure 4:
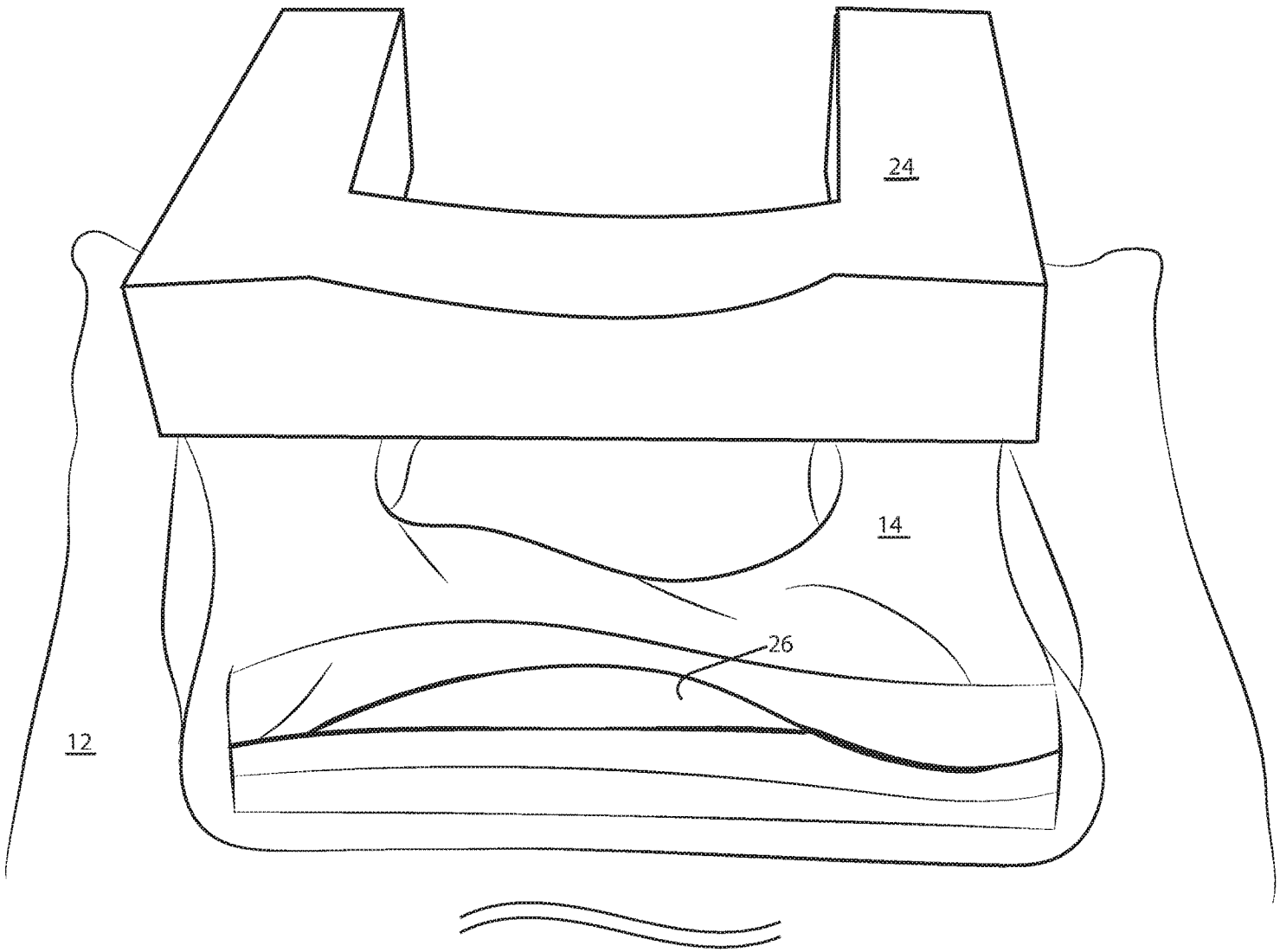
FIG. 4 shows an embodiment of removable support pillow insert and a pocket opening to allow insertion of the support pillow.

As discussed above, the support pillow comprises a pocket or mounting in the pillow case with a support pillow insert. FIG. 4 shows an end view of the pillow cover 10. The support pillow is comprised of a support pillow insert 24 that inserts into the support pillow pocket through the pocket opening 26. The support pillow insert 24 may take many different forms and shapes. In this particular embodiment, the pillow insert and the pocket have a U shape. The form of the support pillow insert in this embodiment comprises a protective material that may have one or more beneficial effects, such as being anti-bacterial, anti-fungal, anti-microbial, water proof, easy to clean, tear resistant, etc. Inside the cover the support pillow insert may comprise many different fillings, including foam rubber, memory foam, buckwheat, cotton, polyester, etc., any material that can provide the necessary support for the user's head.

Figure 5:
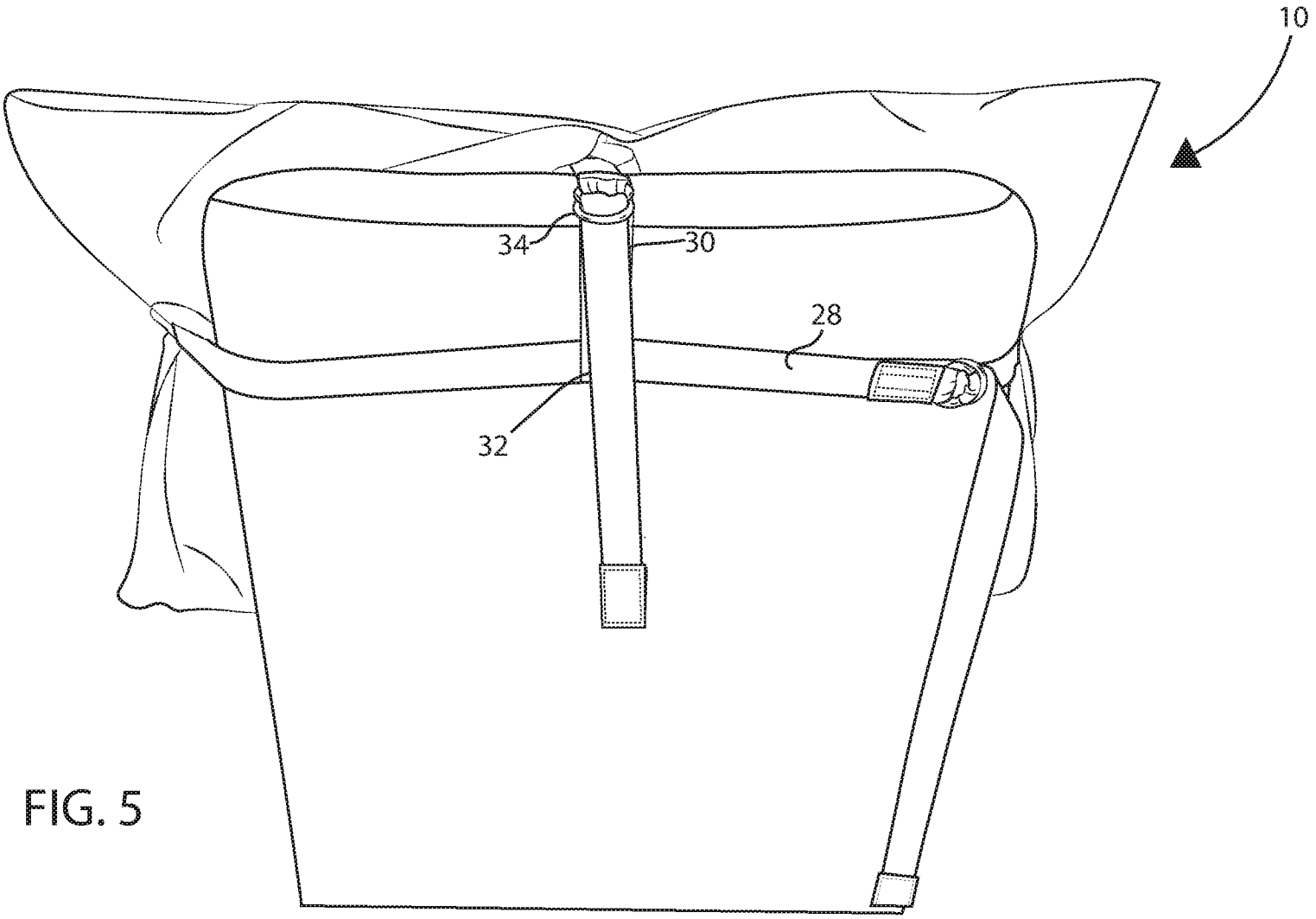
FIGS. 5-7 show embodiments of different fasteners used to attach the pillow cover to a chair.
Figure 6:
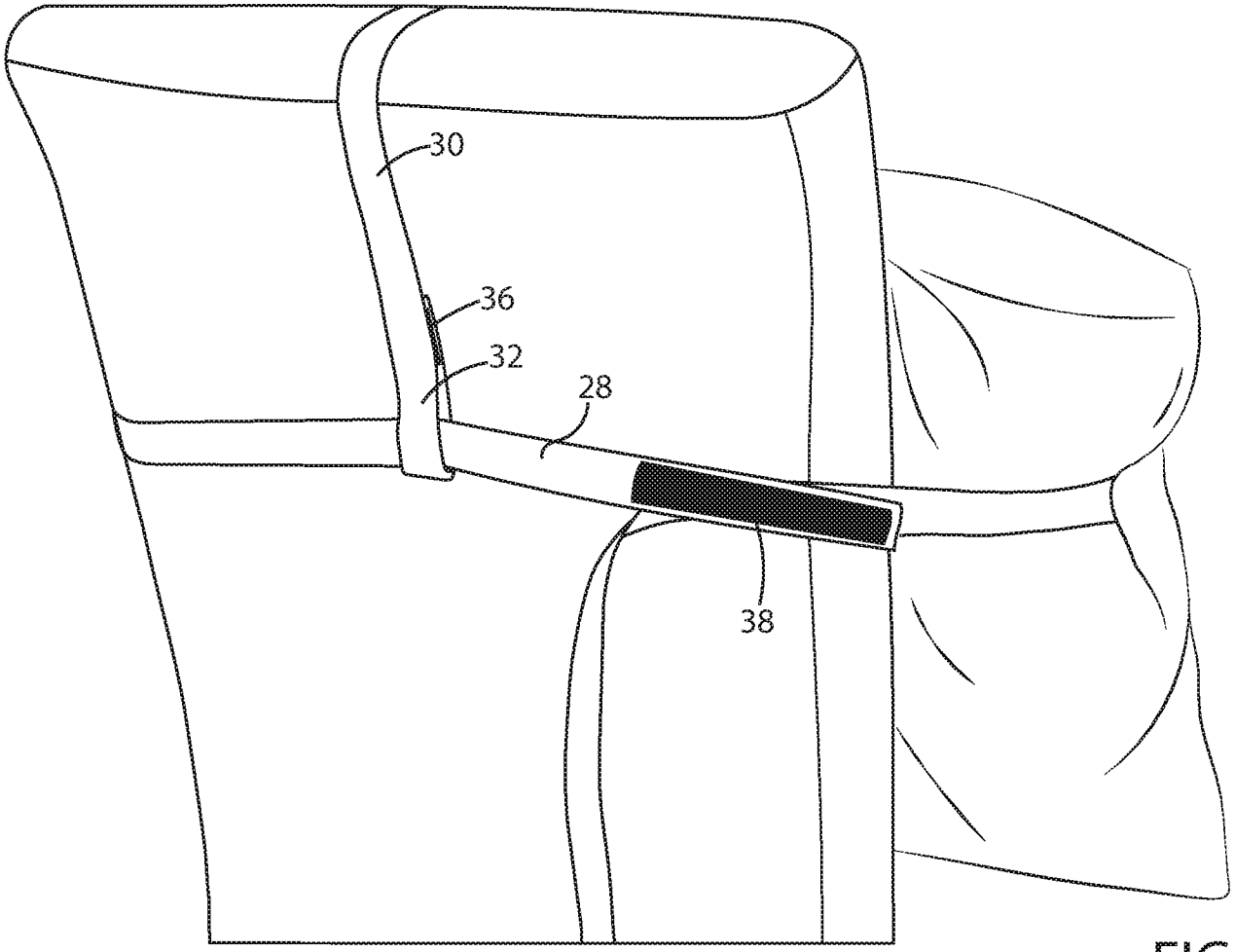
Figure 7:
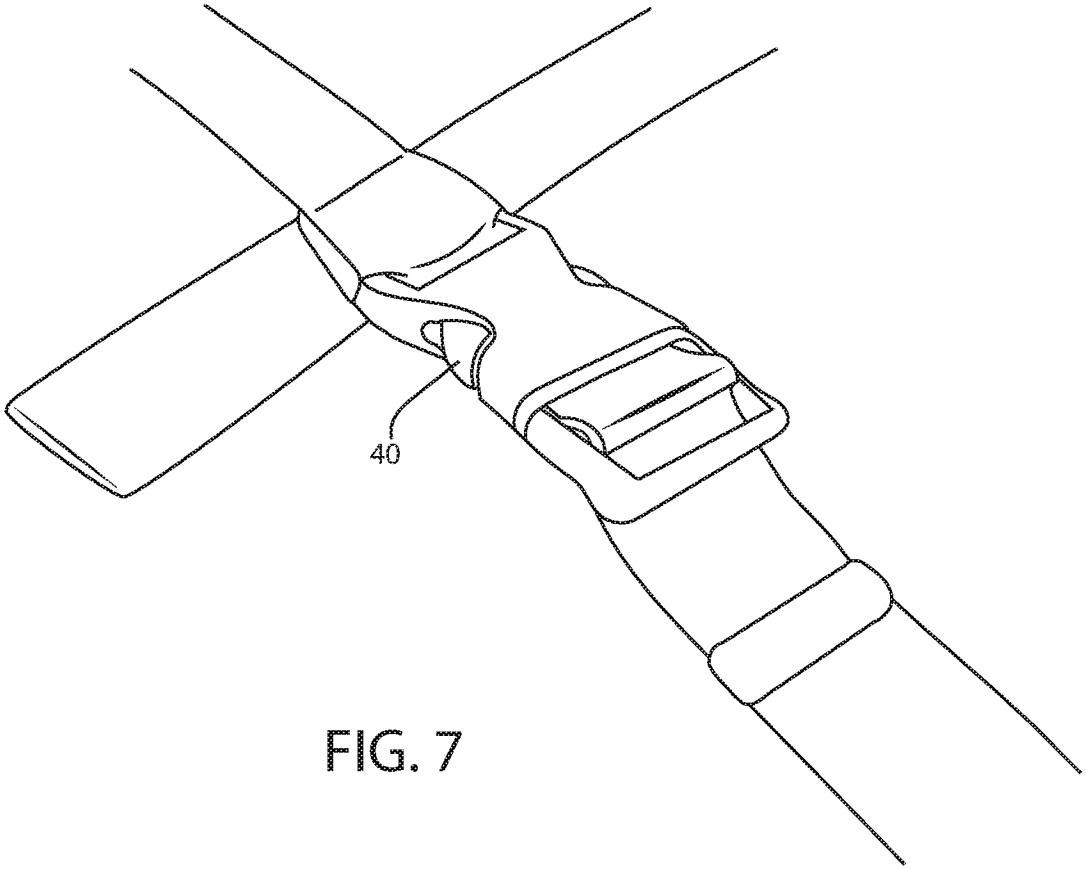

As discussed above, the pillow cover includes a mounting to allow the pillow cover to be adjustably attached to a chair. FIGS. 5-7 show different adjustable straps with fasteners to attach the pillow cover to a chair. Standard pillows typically have rectangular shape, with two longer sides that run horizontally and two shorter sides that run vertically. In the embodiments here, the shorter sides, or ends, have an adjustable, lateral strip that connects them. One of the longer sides will also have a vertical strap that connects to the lateral strap. As shown in FIG. 5, for example, the ends of the pillow cover 10 are connected by an adjustable strap 28. The longer side, which may be referred to as the top, connects to the lateral strap 28 by a vertical strap 30 with adjustable fastener 34. While not very well seen in FIG. 5, the vertical strap 30 may have a hook or other way to attach to the lateral strap 28.

FIG. 6 shows the vertical strap 30 attaching to the lateral strap 28 with an adjustable attachment 32 that is adjustable using a hook and loop closure 36. Similarly, the later strap also has an adjustable attachment 38 to allow the lateral strap to be adjusted to accommodate different widths of chairs. FIG. 7 shows an alternative attachment of a clip 40 that adjustable attaches to the straps to allow adjustment.

Figure 8:
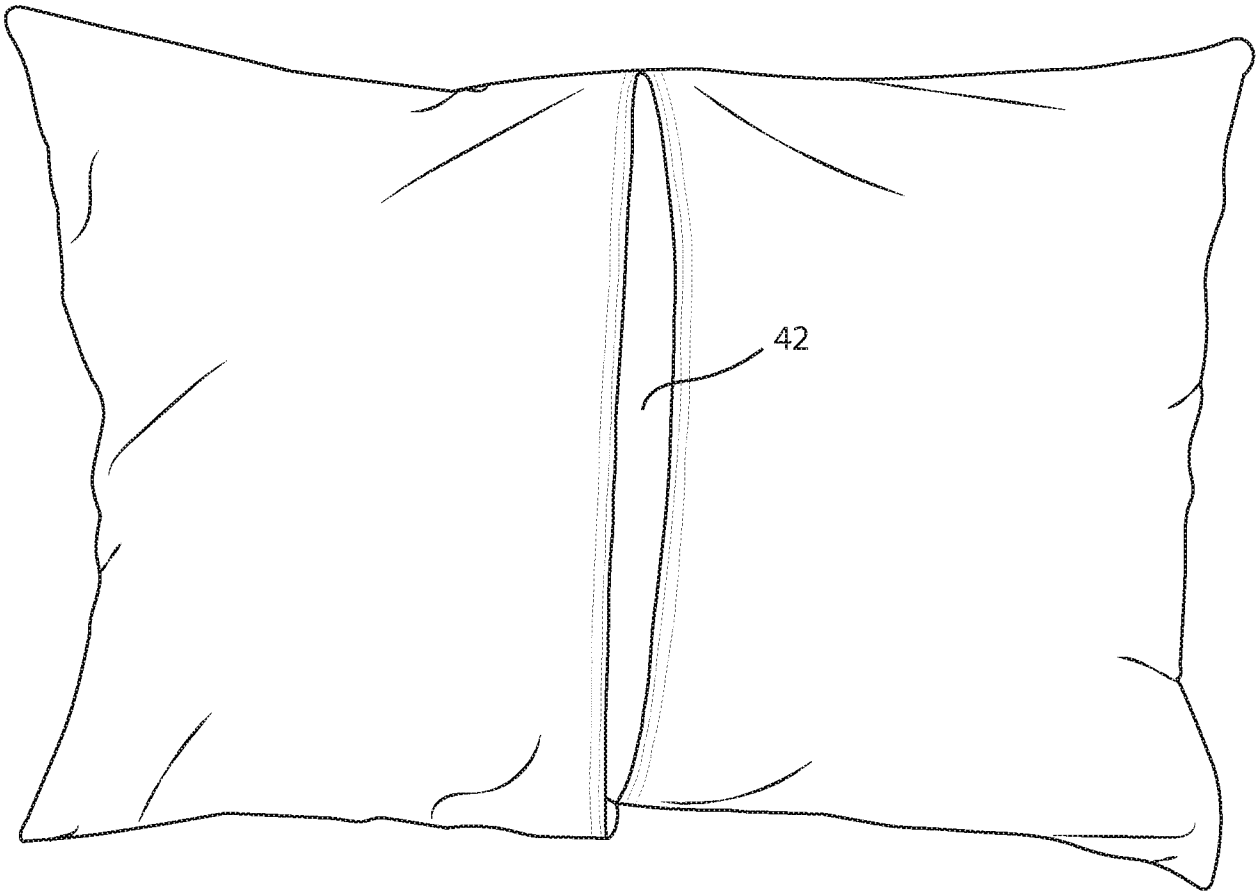
FIG. 8 is a back view of an embodiment of a pillow case having an envelope opening.

As mentioned above, two openings may exist. One may be the pocket opening discussed above that allows insertion of the support pillow insert. FIG. 8 shows an embodiment of an 'envelope' opening 42 that allows the pillow case to be used with a pillow. Alternatively, the pillow case may have openings on either end, much like standard pillow cases.

Figure 9:
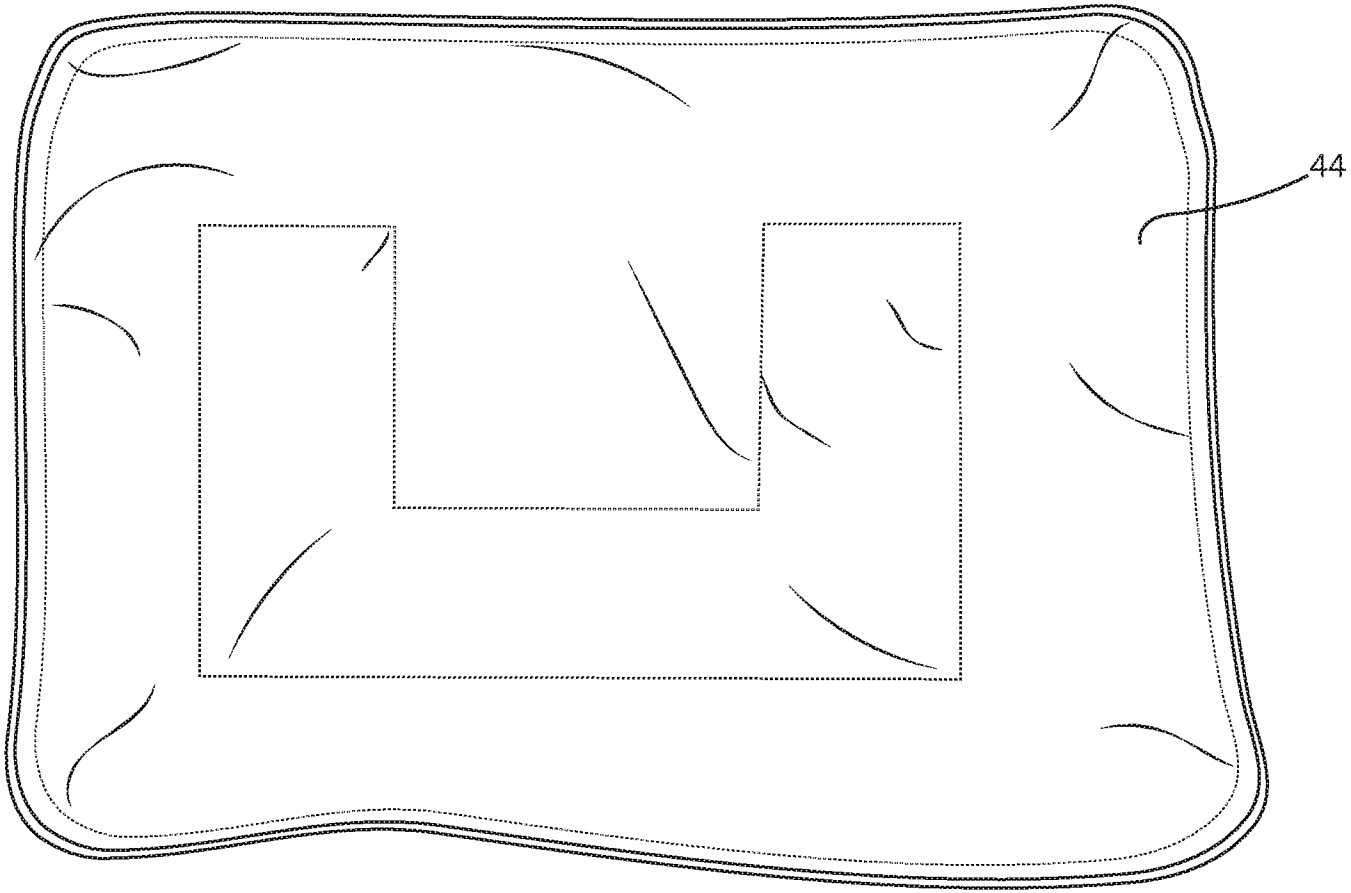
FIG. 9 shows an embodiment of an internal layer of the pillow cover.

In addition to the pillow case having an opening, it may also include a protective layer on the inside. FIG. 9 shows an example of an interior layer of the pillow case 44 that can provide many benefits, similar to the cover of the support pillow insert. These include, but are not limited to, anti-bacterial, anti-fungal, anti-microbial, water proof, easy to clean, tear resistant, etc. In addition, the pillow case will be machine washable.

Figure 10:
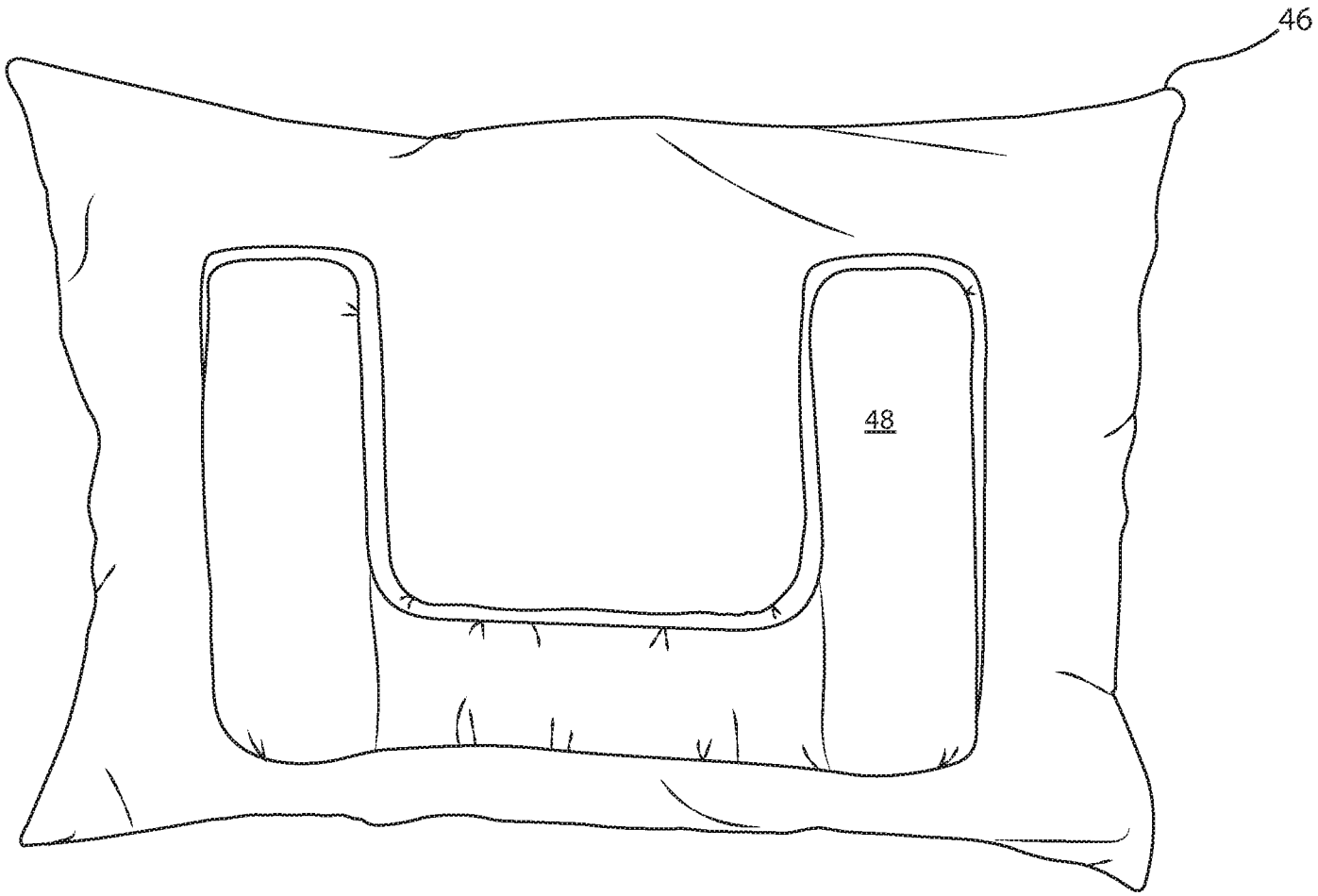
FIG. 10 is a top plan view of one embodiment of a pillow cover having a base case with a support pillow insert into the base case.
Figure 11:
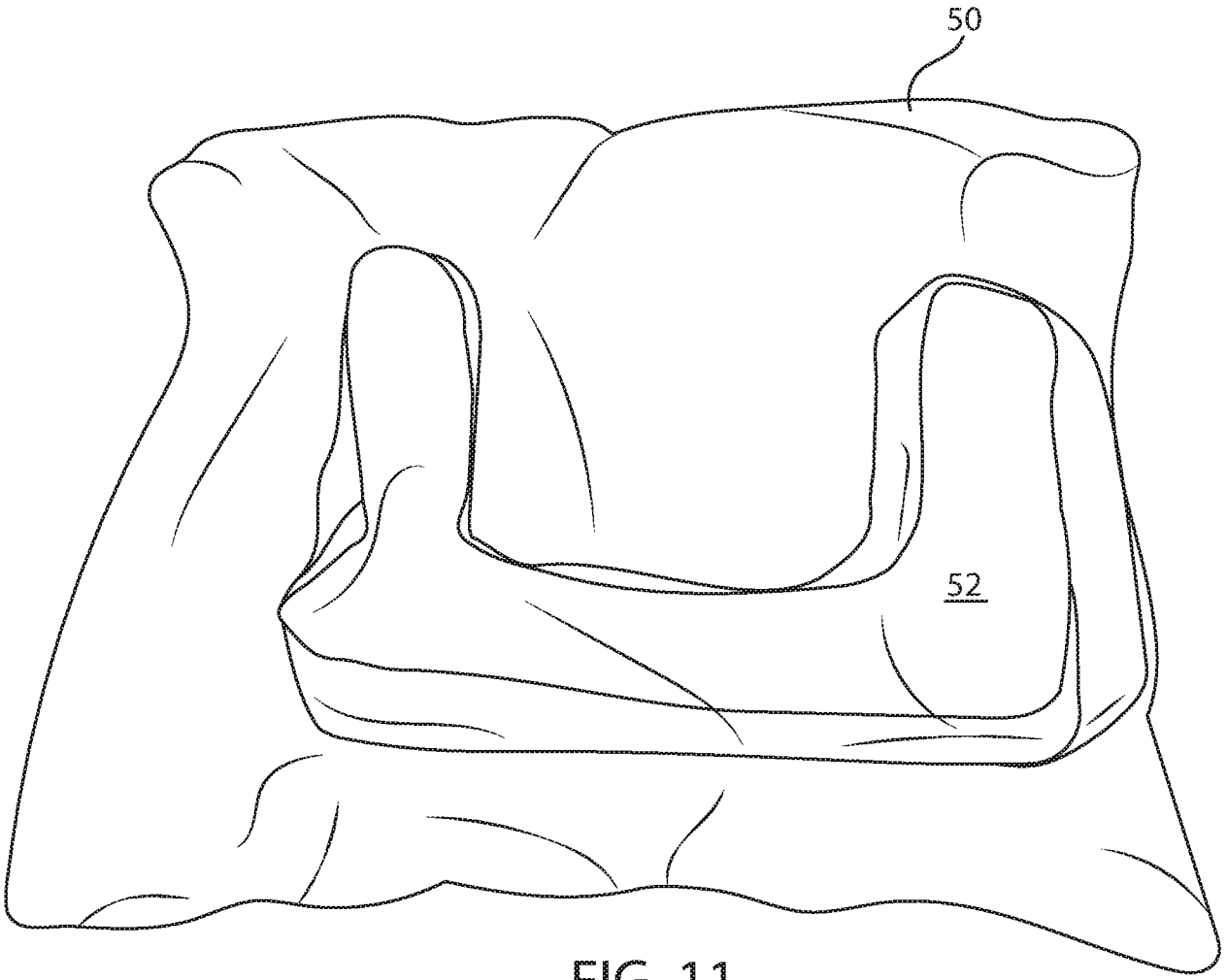
FIG. 11 of an embodiment of a pillow case to cover a base case having a support pillow insert integrated into the base case.

In an alternative embodiment, the support pillow insert will reside on a second case, referred to here as the 'base case.' The base case is a standard pillow case that has the support pillow insert attached to it, such as being sewn to the base case. FIG. 10 shows an embodiment of this type of support pillow insert. The base case 46 has the support pillow insert 48 attached to it. The base case/support pillow insert could comprise many different materials, but would more than likely be machine washable. FIG. 11 shows an embodiment of a pillow case 50 for this type of support pillow insert. In this instance, the pocket 52 has an open back inside the pillow case that would then mate with the support pillow insert from FIG. 9 to form the support pillow portion of the pillow cover.

Variation and modifications exist for the straps, the pillow, sealing of the pillow case, the material, and possible colors. Variations on the attachments include straps, fabric ties, buckles bungee cords, cables, clips, cords, elastic, varied numbers of straps, pins, press studs, rope, safety pins, snaps, twine, Velcro, yarn, zip ties, and zippers. Variations of the pillow include circular pillows, completely closed, hexagon, hole, open at one end, oval, partial hole, a pillow within a pillow, quadrilateral, rectangular, round or square, among others. The closure of the pillow case may include brooches, buttons, clips, cords, cuff links, elastic, frog fasteners, glass studs, grommets and eyelets, hooks and eye, hot glue, hot wax, laces, metal fasteners, needles, patches, pins, press studs, safety pins, sewing, silk, snaps, thread, toggle fasteners, Velcro, yarn, zip ties, and zippers. The material may include water proof materials, lace, silk, cotton, padding, absorbent or repelling materials, performance fabrics, among many others.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A pillow cover comprising:

a pillow case having a U-shaped pocket on a surface of the pillow case, a first opening comprising a pocket opening on a side of the pocket, a cavity, and a second opening comprising a pillow opening, the pillow opening configured to allow the pillow case to receive a standard-sized pillow into the cavity;

a first protective layer inside the cavity adjacent the pocket;

a U-shaped support pillow insert insertable into the pocket through the pocket opening to form a U-shaped support pillow on the surface the pillow case, the U-shaped support pillow configured to limit range of motion of a head of a user when the user is sitting in a chair and a bottom of the U-shaped pillow configured to lie under a neck of the user, the U-shaped support pillow covered with a second protective layer;

a secondary pillow sized to fit on the surface of the pillow case inside a center of the U-shape of the support pillow, the secondary pillow having a depth that does not extend past a depth of the U-shaped support pillow; and one or more straps having adjustable fasteners attached to the pillow case, the straps configured to allow the pillow cover to be adjustably attached to a chair back, the straps comprising a lateral strap connecting two shorter ends of the pillow case and a vertical strap connecting one of a long side of the pillow case to the lateral strap.

2. The pillow cover as claimed in claim 1, wherein the first protective layer comprises an inner anti-bacterial, anti-microbial layer between the cavity and the pocket.

3. The pillow cover as claimed in claim 2, wherein the first protective layer is also at least one of water proof and tear resistant.

4. The pillow cover as claimed in claim 1, wherein the second protective layer comprises an anti-bacterial, anti-microbial fabric.

5. The pillow cover as claimed in claim 4, wherein the fabric is also at least one of water proof and tear resistant.

6. The pillow cover as claimed in claim 1, wherein the adjustable fasteners comprise clips.

7. The pillow cover as claimed in claim 1, wherein the adjustable fasteners comprise hook and loop closures.

* * * * *